US006073489A

United States Patent [19]

French et al.

[11] Patent Number: 6,073,489

[45] Date of Patent: Jun. 13, 2000

[54] TESTING AND TRAINING SYSTEM FOR ASSESSING THE ABILITY OF A PLAYER TO COMPLETE A TASK

[76] Inventors: Barry J. French, 30612 Salem Dr., Bay Village, Ohio 44140; Kevin R. Ferguson, 365 Armour Rd., Avon Lake, Ohio 44012

[21] Appl. No.: 09/034,059

[22] Filed: Mar. 3, 1998

Related U.S. Application Data

[63] Continuation-in-part of application No. 08/554,564, Nov. 6, 1995, and a continuation-in-part of application No. PCT/US96/17580, Nov. 5, 1996, which is a continuation-in-part of application No. 08/554,564, Nov. 6, 1995.

[51] Int. Cl.[7] ..... A61B 5/22

[52] U.S. Cl. ..... 73/379.01

[58] Field of Search ..... 73/379.01, 379.04, 73/379.05; 364/413

[56] References Cited

U.S. PATENT DOCUMENTS

| | | | |
|---|---|---|---|
| 4,751,642 | 6/1988 | Silva et al. | 364/413 |
| 5,229,754 | 7/1993 | Aoki et al. | 340/705 |
| 5,239,463 | 8/1993 | Blair et al. | 364/410 |
| 5,469,740 | 11/1995 | French et al. | 73/379.04 |
| 5,524,637 | 6/1996 | Erikson | 128/779 |

*Primary Examiner*—Max Noori
*Assistant Examiner*—Jewel Thompson
*Attorney, Agent, or Firm*—Renner, Otto, Boisselle & Sklar, P.L.L.

[57] ABSTRACT

A system for assessing a user's movement capabilities creates an accurate simulation of sport to quantify and train several novel performance constructs by employing: proprietary optical sensing electronics for determining, in essentially real time, the player's positional changes in three or more degrees of freedom; and computer controlled sport specific cuing that evokes or prompts sport specific responses from the player. In certain protocols of the present invention, the sport specific cuing may be characterized as a "virtual opponent", that may be kinematically and anthropomorphically correct in form and action. Though the virtual opponent could assume many forms, the virtual opponent is responsive to, and interactive with, the player in real time without any perceived visual lag. The virtual opponent continually delivers and/or responds to stimuli to create realistic movement challenges for the player. The movement challenges are typically comprised of relatively short, discrete movement legs, sometimes amounting to only a few inches of displacement of the player's center of mass. Such movement legs are without fixed start and end positions, necessitating continual tracking of the player's position for meaningful assessment. The virtual opponent can assume the role of either an offensive or defensive player.

3 Claims, 8 Drawing Sheets

TESTING AND TRAINING SYSTEM FOR ASSESSING THE ABILITY OF A PLAYER TO COMPLETE A TASK

CROSS-REFERENCES

The present application is a continuation-in-part application of (parent) application Ser. No. 08/554,564 filed Nov. 6, 1995, "Testing and Training System for Assessing Movement and Agility Skills Without a Confining Field," by Barry J. French and Kevin R. Ferguson. This is also a continuation-in-part of International Application PCT/US96/17580, filed Nov. 5, 1996, now abandoned, which in turn is a continuation-in-part of pending application Ser. No. 08/554,564, filed Nov. 6, 1995.

GOVERNMENT RIGHTS

The present application pertains to an invention that was not performed under any Federally sponsored research and development.

BACKGROUND

A. Field of the Invention

The present invention relates to a system for assessing movement and agility skills and, in particular to a wireless position tracker for continuously tracking and determining player position during movement in a defined physical space through player interaction with tasks displayed in a computer generated, specially translated virtual space for the quantification of the player's movement and agility skills based on time and distance traveled in the defined physical space.

B. The Related Art

Various means, both in terms of protocol and instrumentation, have been proposed for assessing and enhancing sport-specific movement capabilities. None, however, fulfill the requirements for validity, objectivity and accuracy as does the novel measurement constructs of the present invention.

Specific to the present invention, none create an accurate analog of the complex play between offensive and defensive opponents engaged in actual competition with seamless dynamic cueing, continuous position tracking in all relevant planes of movement and sport relevant movement challenges.

The present invention, for the purposes of evaluating a player's sport-specific movement capabilities, tracks the player's positional changes in three degrees (three dimensions) of freedom in real time. Computer-generated dynamic cues replicate the challenges of actual sports competition, as the purpose of the present invention is to measure the player's ability to perform unplanned or planned lateral movements, maximal accelerations and decelerations, abrupt positional changes and the like in a valid testing and training sports simulation.

Specifically, no prior art was uncovered that teaches the core elements of a novel measurement construct of movement capabilities that can be characterized as a "synchronous relationship".

In the context of interactive sports simulations, a synchronous relationship is defined as the player's ability to minimize spatial differences (deviations) over a time interval between his or her vector movements in the physical world coincidental to the vector movements of the dynamic cues that can be expressed as a "virtual opponent".

Certain protocols of the present invention reward the player for successfully minimizing the aforementioned spatial differences over a time interval, thereby enabling the player to move synchronously with the dynamic cueing that may be expressed as a virtual opponent. Uniquely assessed is the player's ability to maintain a synchronous relationship with the virtual opponent.

Alternatively, the dynamic cueing can present movement challenges that assess the player's ability to create an asynchronous event. In the contest of interactive sports simulations, asynchronicity is defined as the player's ability to maximize spatial differences over a time interval between his or her vector movements in the physical world relative to the vector movements of the dynamic cues that can be expressed as a "virtual opponent".

Asynchronicity creates an "out of phase" state relative to the movement of the virtual opponent. In a sports context, an asynchronous event ot sufficient duration allows the player to "evade" or "escape" the virtual opponent.

To quantify the player's ability to either create an asynchronous event, or maintain a synchronous relationship, nine novel measurement constructs have been created. Each of these constructs measure one aspect of the player's global movement skills. Together, these constructs provide valuable information about the player's overall movement capabilities: (Each are disclosed in greater detail elsewhere in this document.)

- Compliance (the ability of the player to maintain synchronous movement.)
- Opportunity (the ability of the player to create an asynchronous movement event)
- Dynamic Reaction Time (the elapsed time for the player to react to attempts of the virtual opponent to create an asynchronous event)
- Phase Lag (the elapsed time player is "out-of-synch")
- First Step Quickness (the player's velocity, acceleration, and/or power while attempting to maintain a synchronous relationship or to create an asynchronous movement event)
- Reactive Bounding (the player's vertical displacements while attempting to maintain a synchronous relationship with the virtual opponent or to create an asynchronous movement event)
- Sports Posture (the player's stance or vertical body position that maximized sport specific performance)
- Functional Cardio-respiratory Status (assessment and training of the player's cardiac response during performance of sport specific movement)
- Vector Changes & Reactive Cutting (the ability of the player to execute abrupt positional changes in response to a virtual opponent)

Five patents are believed to be relevant as representative of the state-of-the art:

Erickson, U.S. Pat. No. 5,524,637 teaches means for measuring physical exertion, expressed as calories, as the game player or exerciser runs or walks in place. In one embodiment a video camera senses vertical (Y plane) oscillations of the player's body as the player watches a screen displaying a virtual landscape that "scrolls past" the player at a rate proportional to the vertical oscillations of the player either running or walking in place. Erickson also teaches continuous monitoring of heart rate during these two unconstrained activities. Erickson does not deliver dynamic cueing for the purposes of quantifying movement capabilities. Erickson does not provide for X or Z plane movement challenges requisite tor the present invention's performance measurements. Nor does Erickson teach means for cycling the heart rate to mimic the demands of sports competition. Essentially, Erickson's invention is an entertaining substitution for a conventional treadmill.

French et. al. U.S. Pat. No. 5,469,740 discloses a testing field that incorporates a multiplicity of force platforms coupled to a display screen. The position of the player is known only when the player is positioned on the force platforms. French does not provide means of continuously tracking the player during movement, nor of determining the direction of player's movement in between force platforms. The force platforms are placed at known fixed distances to enable accurate measurement of velocities, but without continuous tracking in three degrees of freedom, accelerations can not be determined.

French et al provides valid measures of agility, but does not continually track the player's positional changes, which are requisite to evaluating the present invention's Phase constructs.

Silva et al., U.S. Pat. No. 4,751,642 creates a computer simulation of the psychological conditions such as crowd noise associated with sports competition. Silva has no sensing means for tracking the player's movement continuously, but relies only on switches mounted to implements such as a ball to indicate when a task was completed. The continuous position of the athlete is unknown, therefore Silva's invention could not test or train any of the current invention's measurement constructs.

Blair et al., U.S. Pat. No. 5,239,463 employs wireless position tracking to track an observer's position to create a more realistic interaction between the game animation and the observer or player. Blair does not teach quantification of any of the present invention's measurement constructs, nor does he create a sports simulation as contemplated by this present invention.

Kosugi et al., U.S. Pat. No. 5,229,756 teaches means for creating an interactive virtual boxing game where the game player's movement controls the movement of a virtual image that "competes" with a virtual boxer (virtual "opponent"). The virtual image is said to respond accurately to the movement of a human operator.

Kosugi does not continuously track the player's position, only the location of one of the player's feet is known at such times as the player places a foot onto one of eight force platforms. Though the location of one foot can be assumed, the actual position of the body can only be inferred. Without means for continuous, real time tracking of the body, huge gaps in time exist between successive foot placements, dampening the quality of the simulation and precluding performance measures of acceleration, velocity and the like.

Unlike French, et al., the player's starting point, which is the center of the force sensing mat, is not sensored. Consequently, measurements of reaction time, velocity and the like could not be quantified.

Since the real time position of the player's center of gravity (the body center) is unknown, Kosugi's device is unable to perform any of the measurement constructs associated with Phase.

Additionally, Kosugi does not provide for sufficient movement area (movement options) to actually evaluate sport relevant movement capabilities. Kosugi has only eight force platforms, each requiring only a half step of the player to impact.

Kosugi does not teach quantification of any of the present invention's measurement constructs; for that matter, he does not teach quantification of any performance constructs. His game awards the player with points for "successful" responses.

Sports specific skills can be classified into two general conditions:

1.) Skills involving control of the body independent from other players; and

2.) Skills including reactions to other players in the sports activity.

The former includes posture and balance control, agility, power and coordination. These skills are most obvious in sports such as volleyball, baseball, gymnastics, and track and field that demand high performance from an individual participant who is free to move without opposition from a defensive player. The latter encompasses interaction with another player-participant. This includes various offense-defense situations, such as those that occur in football, basketball, soccer, etc.

Valid testing and training of sport-specific skills requires that the player be challenged by unplanned cues which prompt player movement over distances and directions representative of actual game play. The player's optimum movement path should be selected based on visual assessment of his or her spatial relationship with opposing players and/or game objective. A realistic simulation must include a sports relevant environment. Test methods prompting the player to move to fixed ground locations are considered artificial. Nor are test methods employing static or singular movement cues such as a light or a sound consistent with accurate simulations of actual competition in many sports.

To date, no accurate, real time model of the complex, constantly changing, interactive relationship between offensive and defensive opponents engaging in actual competition exists. Accurate and valid quantification of sport-specific movement capabilities necessitates a simulation having fidelity with real world events.

At the most primary level, sports such as basketball, football and soccer can be characterized by the moment to moment interaction between competitors in their respective offensive and defensive roles. It is the mission of the player assuming the defensive role to "contain", "guard", or neutralize the offensive opponent by establishing and maintaining a real-time synchronous relationship with the opponent. For example, in basketball, the defensive player attempts to continually impede the offensive player's attempts to drive to the basket by blocking with his or her body the offensive player's chosen path, while in soccer the player controlling the ball must maneuver the ball around opposing players.

The offensive player's mission is to create a brief asynchronous event, perhaps of only a few hundred milliseconds in duration, so that the defensive player's movement is no longer in "phase" with the offensive player's. During this asynchronous event, the defensive player's movement no longer mirrors, i.e. is no longer synchronous with, his or her offensive opponent. At that moment, the defensive player is literally "out of position" and therefore is in a precarious position, thereby enhancing the offensive player's chances of scoring. The offensive player can create an asynchronous event in a number of ways. The offensive player can "fake out" or deceive his or her opponent by delivering purposefully misleading information as to his or her immediate intentions. Or the offensive player can "overwhelm" his opponent by abruptly accelerating the pace of the action to levels exceeding the defensive player's movement capabilities.

To remain in close proximity to an offensive opponent, the defensive player must continually anticipate or "read" the offensive player's intentions. An adept defensive player will anticipate the offensive player's strategy or reduce the offensive player's options to those that can easily be contained. This must occur despite the offensive player's attempts to disguise his or her actual intentions with purposely deceptive and unpredictable behavior. In addition to being able to "read", i.e., quickly perceive and interpret the intentions of the offensive player, the defensive player must also possess adequate sport-specific movement skills to establish and maintain the desired (from the perspective of the defensive player) synchronous spatial relationship.

These player-to-player interactions are characterized by a continual barrage of useful and purposefully misleading visual cues offered by the offensive player and constant reaction and maneuvering by the defensive participant. Not only does the defensive player need to successfully interpret visual cues "offered" by the offensive player, but the offensive player must also adeptly interpret visual cues as they relate to the defensive player's commitment, balance and strategy. Each player draws from a repertoire ot movement skills which includes balance and postural control, the ability to anticipate defensive responses, the ability to generate powerful, rapid, coordinated movements, and reaction times that exceed that of the opponent. These sport-specific movement skills are often described as the functional or motor related components of physical fitness.

The interaction between competitors frequently appears almost chaotic, and certainly staccato, as a result of the "dueling" for advantage. The continual abrupt, unplanned changes in direction necessitate that the defensive player maintain control over his or her center of gravity throughout all phases of movement to avoid over committing. Consequently, movements of only fractions of a single step are common for both the defensive and offensive players. Such abbreviated movements insure that peak or high average velocities are seldom, if ever, are achieved. Accordingly, peak acceleration and power are more sensitive measures of performance in the aforementioned scenario. Peak acceleration of the center of mass can be achieved more rapidly than peak velocity, often in one step or less, while power can relate the acceleration over a time interval, making comparisons between players more meaningful.

At a secondary level, all sports situations include decision-making skills and the ability to focus on the task at hand. The present invention simulation trains participants in these critical skills. Therefore, athletes learn to be "smarter" players due to increased attentional skills, intuition, and critical, sports related reasoning.

Only through actual game play, or truly accurate simulation of game play, can the ability to correctly interpret and respond to sport specific visual cues be honed. The same requirement applies to the refinement of the sport-specific components of physical fitness that is essential for adept defensive and offensive play. These sport-specific components include reaction time, balance, stability, agility and first step quickness.

Through task-specific practice, athletes learn to successfully respond to situational uncertainties. Such uncertainties can be as fundamental as the timing of the starter's pistol, or as complex as detecting and interpreting continually changing, "analog" stimuli presented by an opponent. To be task-specific, the type of cues delivered to the player must simulate those experienced in the player's sport. Task-specific cueing can be characterized, for the purposes of this document, as either dynamic or static.

Dynamic cueing delivers continual, "analog" feedback to the player by being responsive to, and interactive with, the player. Dynamic cueing is relevant to sports where the player must possess the ability to "read" and interpret "telegraphing" kinematic detail in his or her opponent's activities. Players must also respond to environmental cues such as predicting the path of a ball or projectile for the purposes of intercepting or avoiding it. In contrast, static cueing is typically a single discreet event, and is sport relevant in sports such a track and field or swimming events. Static cues require little cerebral processing and do not contribute to an accurate model of sports where there is continuous flow of stimuli necessitating sequential, real time responses by the player. At this level, the relevant functional skill is reaction time, which can be readily enhanced by the present invention's simulation.

In sports science and coaching, numerous tests of movement capabilities and reaction time are employed. However, these do not subject the player to the type and frequency of sport-specific dynamic cues requisite to creating an accurate analog of actual sports competition described above.

For example, measures of straight-ahead speed such as the 100-meter and 40 yard dash only subject the player to one static cue, i.e., the sound of the gun at the starting line. Although the test does measure a combination of reaction time and speed, it is applicable to only one specific situation (running on a track) and, as such, is more of a measurement of capacity, not skill. In contrast, the player in many other sports, whether in a defensive or offensive role, is continually bombarded with cues that provide both useful and purposely misleading information as to the opponent's immediate intentions. These dynamic cues necessitate constant, real time changes in the player's movement path and velocity, such continual real-time adjustments preclude a player from reaching maximum high speeds as in a 100-meter dash. Responding successfully to dynamic cues places constant demand on a player's agility and the ability to assess or read the opposing player intentions.

There is another critical factor in creating an accurate analog of sports competition. Frequently, a decisive or pivotal event such as the creation of an asynchronous event does not occur from a preceding static or stationary position by the players. For example, a decisive event most frequently occurs while the offensive player is already moving and creates a phase shift by accelerating the pace or an abrupt change in direction. Consequently, it is believed that the most sensitive indicators of athletic prowess occur during abrupt changes in vector direction or pace of movement from "pre-existing movement". All known test methods are believed to be incapable of making meaningful measurements during these periods.

SUMMARY OF THE INVENTION

The present invention creates an accurate simulation of sport to quantify and train several novel performance constructs by employing:

Proprietary optical sensing electronics (discussed below) for determining, in essentially real time, the player's three dimensional positional changes in three or more degrees of freedom (three dimensions).

Computer controlled sport specific cueing that evokes or prompts sport specific responses from the player. In certain protocols of the present invention, the sport specific cueing could be characterized as a "virtual opponent", that is preferably—but not necessarily—kinematically and anthropomorphically correct in form and action. Though the virtual opponent could assume many forms, the virtual opponent is responsive to, and interactive with, the player in real time without any perceived visual lag. The virtual opponent continually delivers and/or responds to stimuli to create realistic movement challenges for the player. The movement challenges are typically comprised ot relatively short, discrete movement legs, sometimes amounting to only a few inches of displacement of the player's center of mass. Such movement legs are without fixed start and end positions, necessitating continual tracking of the player's position for meaningful assessment.

The virtual opponent can assume the role of either an offensive or defensive player. In the defensive role, the virtual opponent maintains a synchronous relationship with the player relative to the player's movement in the physical world. Controlled by the computer to match the capabilities of each individual player, the virtual opponent "rewards" instances of improved player performance by allowing the player to outmaneuver ("get by") him. In the offensive role, the virtual opponent creates asynchronous events to which the player must respond in time frames set by the computer depending on the performance level of the player. In this case, the virtual opponent "punishes" lapses in the player's performance, i.e., the inability of the player to precisely follow a prescribed movement path both in terms of pace and precision, by outmaneuvering the player.

It is important to note that dynamic cues allow for moment to moment (instantaneous) prompting of the player's vector direction, transit rate and overall positional changes. In contrast to static cues, dynamic cues enable precise modulation of movement challenges resulting from stimuli constantly varying in real time.

Regardless of the virtual opponent's assumed role (offensive or defensive), when the protocol employs the virtual opponent, the virtual opponent's movement cues are "dynamic" so as to elicit sports specific player responses. This includes continual abrupt explosive changes of direction and maximal accelerations and decelerations over varying vector directions and distances.

BRIEF DESCRIPTION OF THE DRAWINGS

The above and other objects, advantages and features of the present invention will become apparent from the following description taken in conjunction with the accompanying drawings in which.

DETAILED DESCRIPTION OF THE INVENTION

Figure 1:
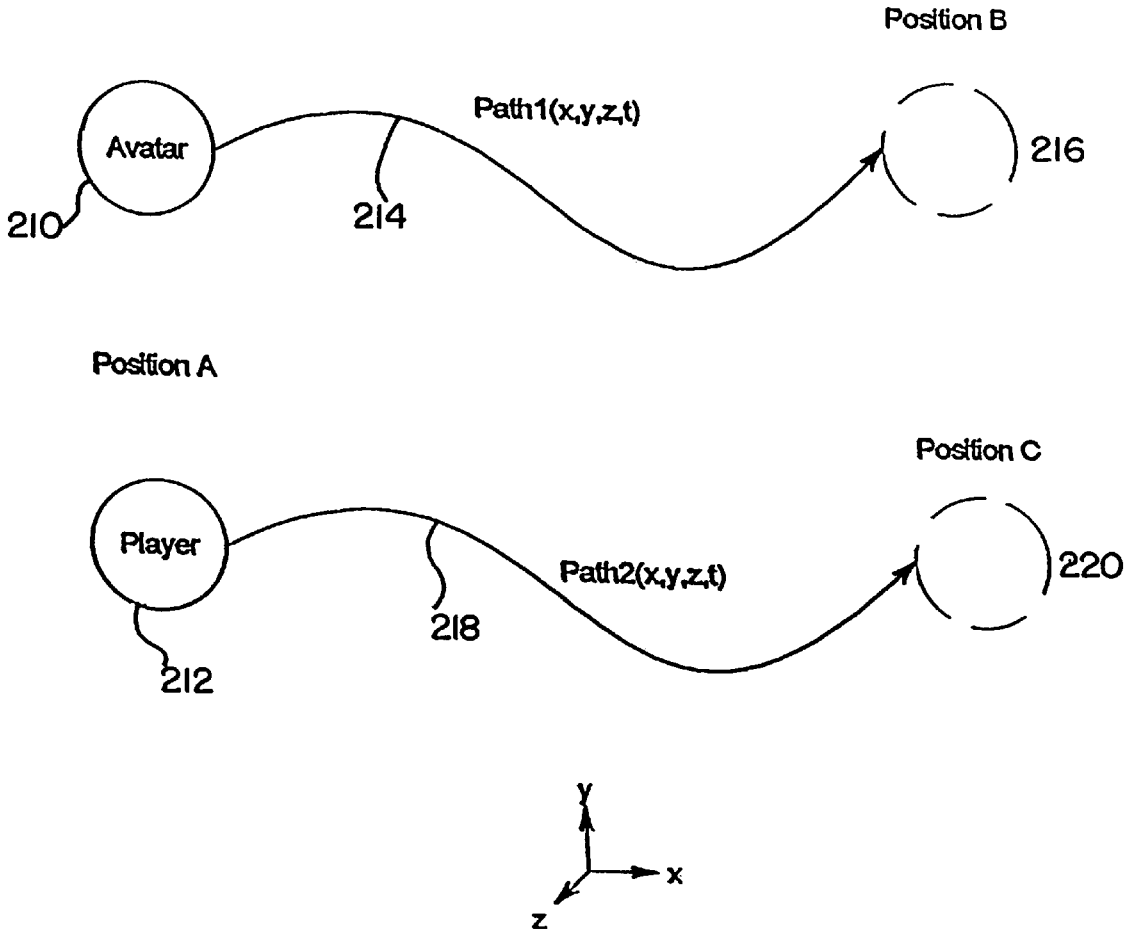
FIG. 1 is a graphical representation of a simulated task that the system executes to determine Compliance.

Computer simulations model and analyze the behavior of real world systems. Simulations are essentially "animation with a sense of purpose." The present invention's software applies the principles of physics to model accurately and with fidelity competitive sports by considering factors such as velocity, displacement, acceleration, deceleration and mass of the player and the objects the player interacts with, and controls, in the virtual world simulation.

The present invention tracks the player's motion, or more precisely, three dimensional displacements in real time using optical position sensing technology. The measurements are currently being made in three degrees-of-freedom (axis of translation) from X, Y, Z translations. Displacements are the distance traveled by the player in the X, Y or Z planes from a fixed reference point and is a vector quantity. The present invention measurement constructs employ displacements over time in their calculations. Accurate quantification of quantities such as work, force, acceleration and power are dependent on the rate of change of elementary quantities such as body position and velocity. Accordingly, the present invention calculates velocity (V) as follows:

V=D/T, where V has the units of meters per second (m/s), D is distance in meters and T is time in seconds.

In three-dimensional space, D is computed by taking the change in each of the separate bilateral directions into account. If dX, dY, dZ represent the positional changes between successive three dimensional bilateral directions, then the distance D is given by the following formula $$D=sqrt(dX*dX+dY*dY+dZ*dZ),$$

where "sqrt" represents the square root operation. The velocity can be labeled positive for one direction along a path and negative for the opposite direction.

This procedure can also be used to calculate the acceleration A of the player along the movement path by taking the change in velocity (v) between two consecutive points and dividing by the time (t) interval between these points. This approximation of the acceleration A of the player is expressed as a rate of change with respect to time as follows $$A=dV/T,$$

where dV is the change in velocity and T is the time interval. Acceleration is expressed in terms of meters per second per second.

Knowledge of the player's acceleration enables calculation of the force (F). The force is related to the mass (M), given in kilograms, and acceleration by the formula $$F=M*A.$$

The international standard of force is a Newton, which is equivalent to a kilogram mass undergoing an acceleration of one meter per second per second acting on the player by the distance that the player moves while under the action of the force. The expression for work (W) is given by $$W=F*d.$$

The unit of work is a joule, which is equivalent to a newton-meter.

Power P is the rate of work production and is given by the following formula $$P=W/T.$$

The standard unit tor power is the watt and it represents one joule of work produced per second.

NOVEL MEASUREMENT CONSTRUCTS

The present invention creates a unique and sophisticated computer sports simulator faithfully replicating the ever-changing interaction between offensive and defensive opponents. This fidelity with actual competition enables a global and valid assessment of an offensive or defensive player's functional, sport-specific performance capabilities. Several novel and interrelated measurement constructs have been derived and rendered operable by specialized position-sensing hardware and interactive software protocols.

The position-sensing hardware tracks the player 36 in the defined physical space 12 at a sample rate of 500 Hz. The 500 Hz sampling rate is attained by modifying commercially available electromagnetic, acoustic and video/optical technologies well known to those of ordinary skill in the art. Additionally, other preferred specifications imposed upon the system 10 include: a preferred tracking volume approximately 432 cubic feet (9 ft. W×8 ft. D×6 ft. H) beginning at a suitable viewing distance from the monitor, absolute position accuracy of one inch or better in all dimension over the tracking volume; resolution of 0.25 inch or better in all dimensions over the tracking volume for smooth, precise control of the high resolution video feedback; a video update rate approximately 30 Hz; and measurement latency less than 30 milliseconds to serve as a satisfying, real-time, feedback tool for human movement.

The global measures are:

Compliance—A novel global measure of the player's core defensive skills is the ability of the player to maintain a synchronous relationship with the dynamic cues that are often expressed as an offensive virtual opponent. The ability to faithfully maintain a synchronous relationship with the virtual opponent is expressed either as compliance (variance or deviation from a perfect synchronous relationship with the virtual opponent) and/or as absolute performance measures of the player's velocity, acceleration and power. An integral component of such a synchronous relationship is the player's ability to effectively change position, i.e., to cut, etc. as discussed below. Compliance is determined as follows:

Referring to FIG. 1, a) A beacon, a component of the optical tracking system, is worn at the Player's waist.

b) At Position A, software scaling parameters make the virtual opponent 210, coordinates in the virtual environment equivalent to the player's 212 coordinates in the physical environment.

c) The system's video displays the virtual opponent's movement along Path1 214 as a function of dimensions X, Y and X, and time (x,y,z,t) to a virtual Position B 216.

d) In response, the Player moves along Path2 (x,y,z,t) 218 to a near equivalent physical Position C 220. The Player's objective is to move efficiently along the same path in the physical environment from start to finish, as does the avatar in the virtual environment. However, since the virtual opponent typically moves along random paths and the Player is generally not as mobile as the virtual opponent, the player's movement path usually has some position error measured at every sample interval.

e) The system calculates at each sampling interval the Player's new position, velocity, acceleration, and power, and determines the Player's level of compliance characterized as measured deviations from the original virtual opponent 210-Player 212 spacing at position A.

f) The system provides real time numerical and graphical feedback of the calculations of part e.

Figure 2:
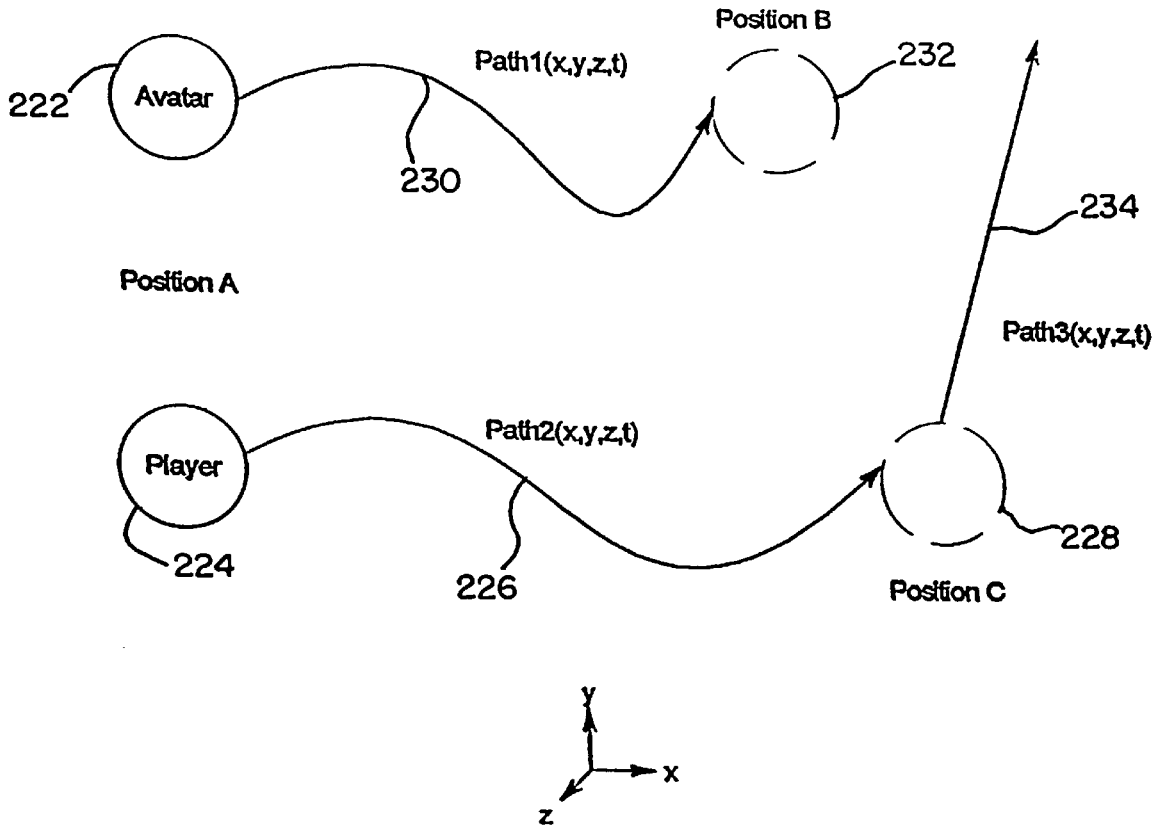
FIG. 2 is a graphical representation of a simulated task that the system executes to determine Opportunity.
Figure 3:
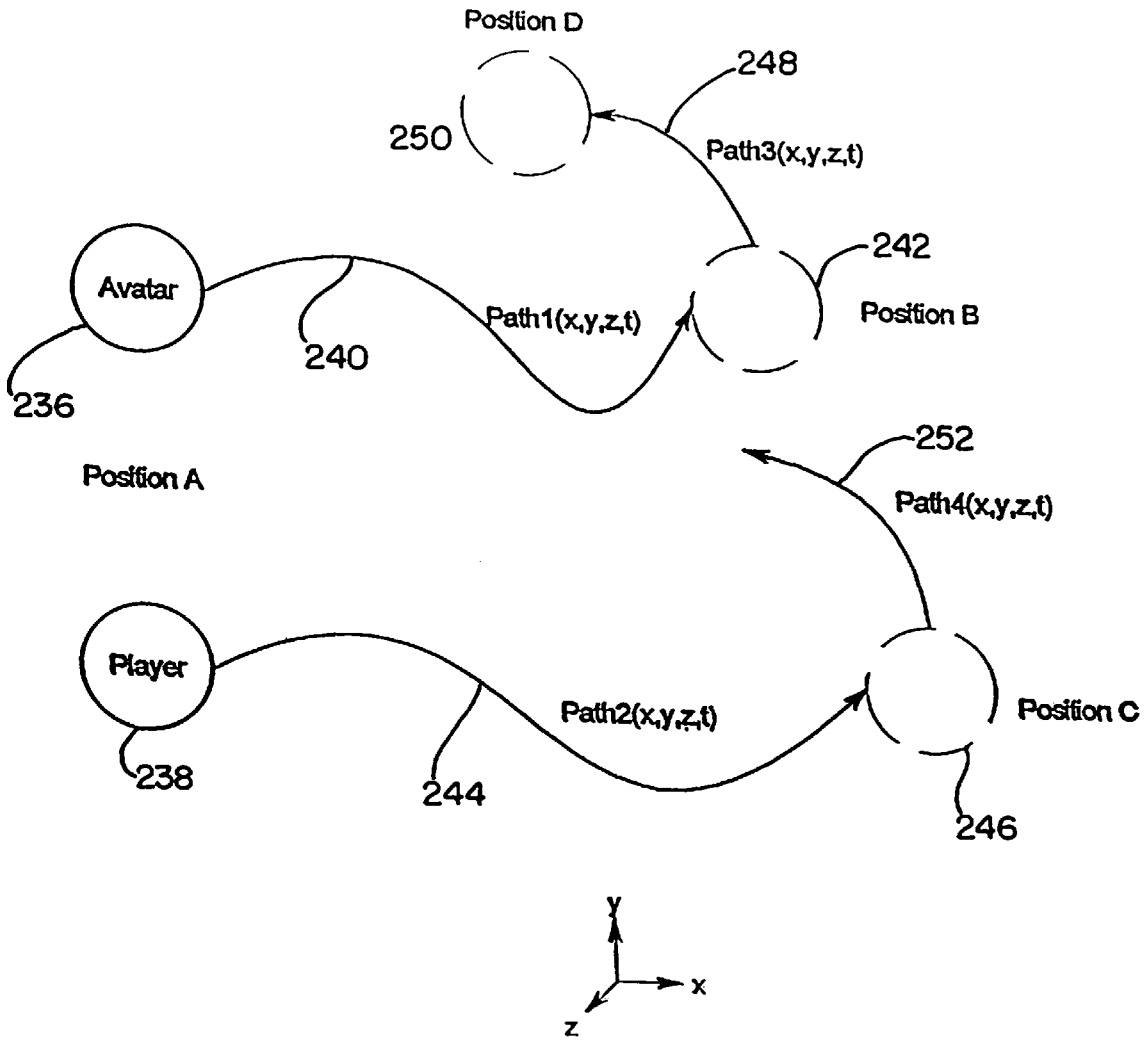
FIG. 3 is a graphical representation of a simulated task that the system executes to determine Dynamic Reaction Time.
Figure 4:
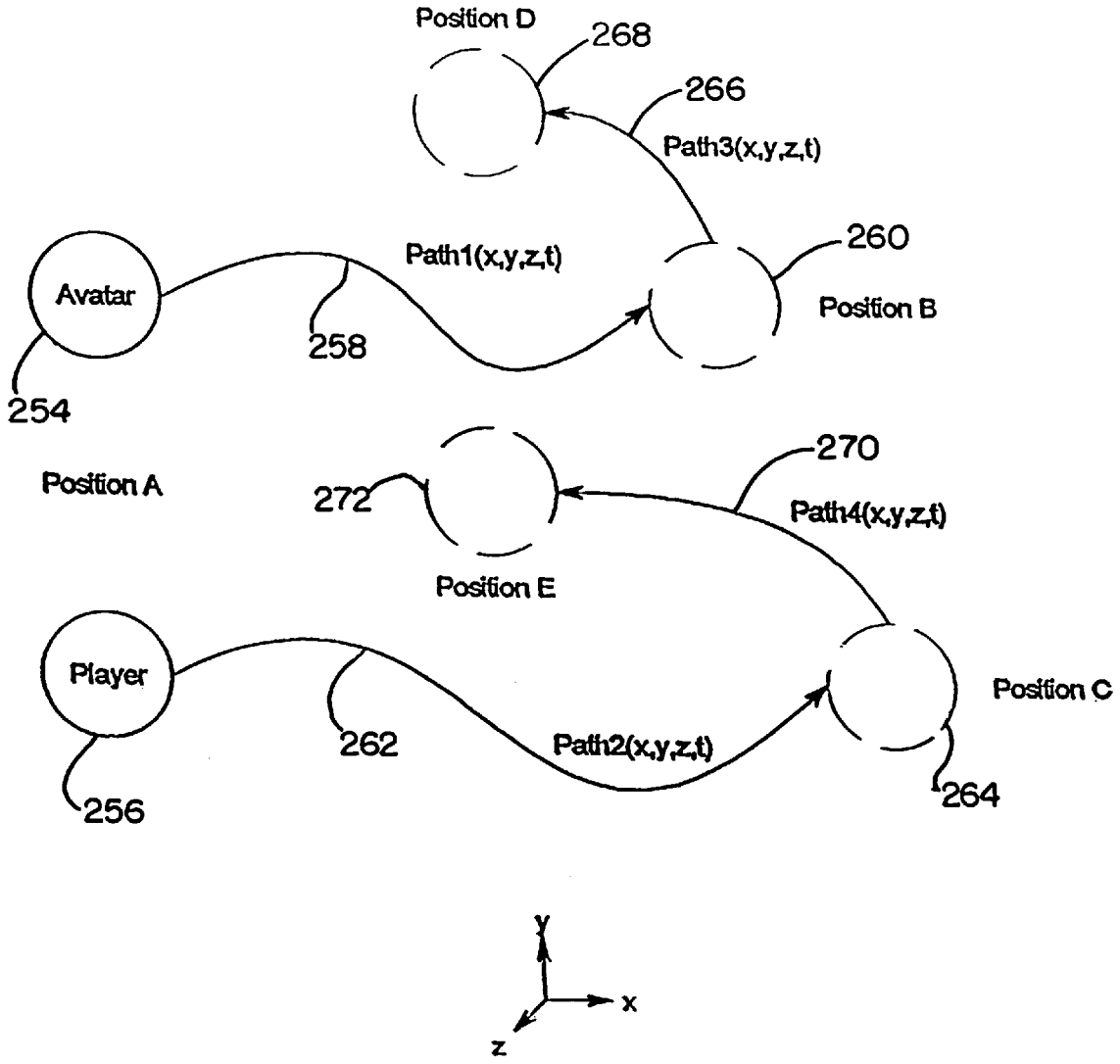
FIG. 4 is a graphical representation of a simulated task that the system executes to determine Dynamic Phase Lag.

Opportunity—At such time as the player assumes an offensive role, the player's ability to create an asynchronous movement event is quantified. The player's ability to execute abrupt changes (to cut) in his or her movement vector direction, expressed in the aforementioned absolute measures of performance, is one of the parameters indicative of the player's ability to create this asynchronous movement event. Opportunity is determined as follows:

Referring to FIG. 2, a) A beacon, a component of the optical tracking system, is worn at the Player's waist.

b) At Position A, software scaling parameters make the virtual opponent 222, coordinates in the virtual environment equivalent to the player's 224 coordinates in the physical environment.

c) The Player moves along Path2 (x,y,z,t) 226 to a physical Position C 228. The Player's objective is to maximize his/her movement skills in order to elude the virtual opponent 222.

d) In response, the system's video displays the virtual opponent's movement along Path1(x,y,z,t) 230 to an equivalent virtual Position B 232. The virtual opponent's movement characteristics are programmable and modulated over time in response to the Player's performance.

e) The system calculates at each sampling interval the Player's new position velocity, acceleration, and power, and determines the moment the Player has created sufficient opportunity to abruptly redirect his/her movement along Path3(x,y,z,t) 234 to intersect the virtual opponent's x-y plane to elude and avoid collision with the virtual opponent.

f) The system provides real time numerical and graphical feedback of the calculations of part e.

A number of performance components are essential to successfully executing the two aforementioned global roles. Accordingly the present invention assesses the following:

1.) Dynamic Reaction Time—Dynamic Reaction Time is a novel measure of the player's ability to react correctly and quickly in response to cueing that prompts a sport specific response from the player. It is the elapsed time from the moment the virtual opponent attempts to improve its position (from the presentation of the first indicating stimuli) to the player's initial correct movement to restore a synchronous relationship (player's initial movement along the correct vector path).

Dynamic Reaction Time is a measurement of ability to respond to continually changing, unpredictable stimuli, i.e., the constant faking, staccato movements and strategizing that characterizes game play. The present invention uniquely measures this capability in contrast to systems providing only static cues which do not provide for continual movement tracking.

Reaction time is comprised of four distinct phases: the perception of and interpretation of the visual and/or audio cue, appropriate neuromuscular activation and musculoskeletal force production resulting in physical movement. It is important to note that Dynamic Reaction Time, which is specifically measured in this protocol, is a separate and distinct factor from rate and efficiency of actual movement which are dependent on muscular power, joint integrity, movement strategy and agility factors. Function related to these physiological components is tested in other protocols including Phase Lag and 1st Step Quickness.

Faced with the offensive player's attempt to create an asynchronous event, the defensive player must typically respond within fractions of a second to relevant dynamic cues if the defensive player is to establish or maintain the desired synchronous relationship. With such minimum response time, and low tolerance for error; the defensive player's initial response must typically be the correct one. The player must continually react to and repeatedly alter direction and/or velocity during a period of continuous movement. Any significant response lag or variance in relative velocity and/or movement direction between the player and virtual opponent places the player irrecoverably out of position.

Figure 8:
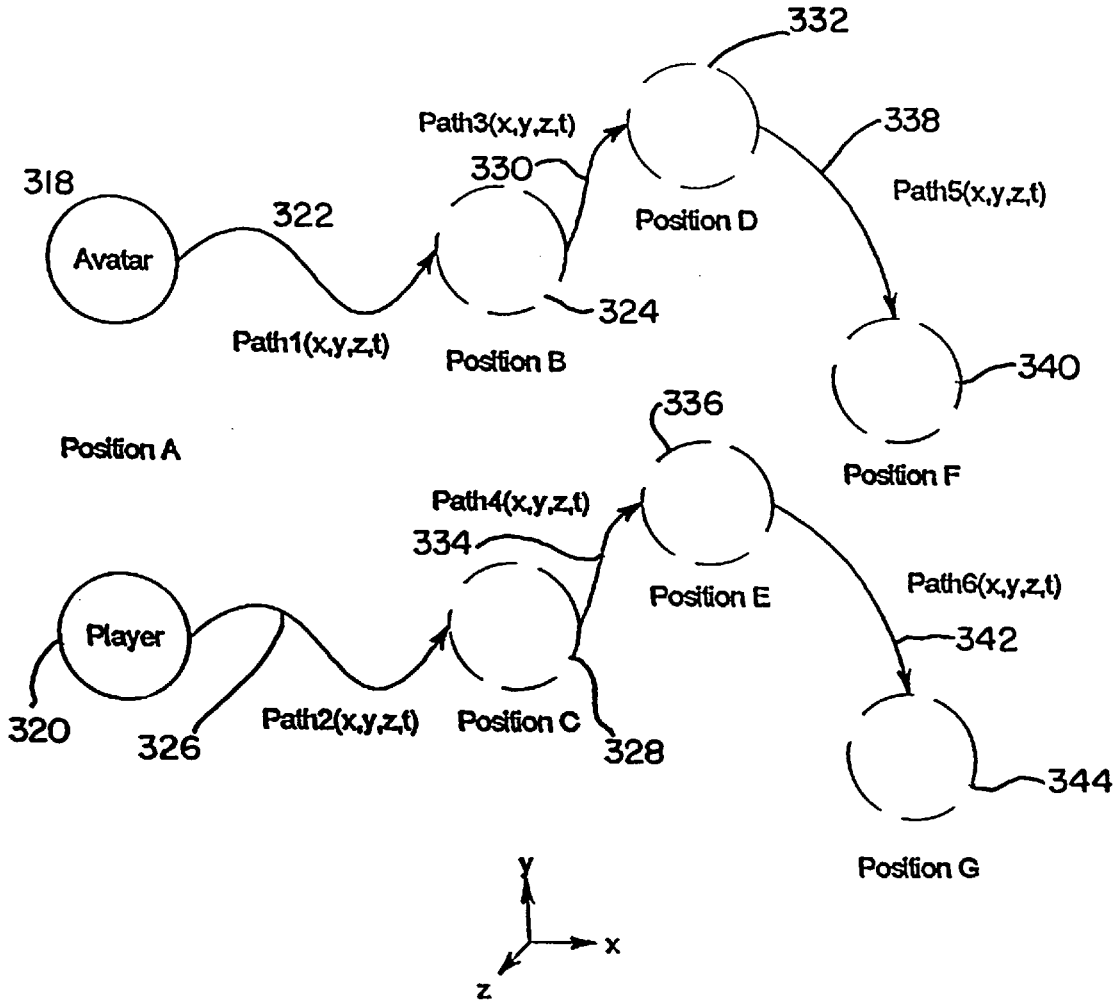
FIG. 8 is a graphical representation of a simulated task that the system executes to determine Dynamic Reactive Cutting.

Relevant testing must provide for the many different paths of movement by the defensive player that can satisfy a cue or stimulus. The stimulus may prompt movement side to side (the X translation), fore and aft (the Z translation) or up or down (the Y translation). In many instances, the appropriate response may simply involve a twist or torque of the player's body, which is a measure of the orientation, i.e., a yaw, pitch or roll. Dynamic reaction time is determined as follows:

Referring to FIG. 8, a) A beacon, a component of the optical tracking system, is worn at the Player's waist.

b) At Position A, software scaling parameters make the virtual opponent 236, coordinates in the virtual environment equivalent to the player's 238 coordinates in the physical environment.

c) The system's video displays the virtual opponent's movement along Path1(x,y,z,t)240 to a virtual Position B 242.

d) In response, the Player moves along Path2(x,y,z,t) 244 to a near equivalent physical Position C 246. The Player's objective is to move efficiently along the same path in the physical environment from start to finish as does the virtual opponent in the virtual environment. However, since the virtual opponent typically moves along random paths and the Player is generally not as mobile as the virtual opponent, the player's movement path usually has some position error measured at every sample interval.

e) Once the virtual opponent reaches Position B 242, it immediately changes direction and follows Path3(x,y,z,t) 248 to a virtual Position D 250. The Dynamic Reaction Timer is started after the virtual opponent's x, y, or z velocity component of movement reaches zero at Position B 242 and its movement along Path3(x,y,z,t) 248 is initiated.

f) The Player perceives and responds to the virtual opponent's new movement path by moving along Path4(x,y,z,t) 252 with intentions to comply to virtual opponent's new movement path. The Dynamic Reaction Timer is stopped at the instant the Player's x, y, or z velocity component of movement reaches zero at Position C 246 and his/her movement is redirected along the correct Path4(x,y,z,t) 252.

g) The system calculates at each sampling interval the Player's new position velocity, acceleration, and power.

h) The system provides real time numerical and graphical feedback of the calculations of part g and the Dynamic Reaction Time.

2.) Dynamic Phase Lag—Another novel measurement is "Phase Lag"; defined as the elapsed time that the player is "out of phase" with the cueing that evokes a sport specific response from the player. It is the elapsed time from the end of Dynamic Reaction Time to actual restoration of a synchronous relationship by the player with the virtual opponent. In sports vernacular, it is the time required by the player to "recover" after being "out-of-position" while attempting to guard his opponent. Phase Lag is determined as follows:

Referring to FIG. 9, a) A beacon, a component of the optical tracking system, is worn at the Player's waist.

b) At Position A, software scaling parameters make the virtual opponent 254, coordinates in the virtual environment equivalent to the player's 256 coordinates in the physical environment.

c) The system's video displays the virtual opponent's movement along Path1(x,y,z,t) 258 to a virtual Position B 260.

d) In response, the Player moves along Path2(x,y,z,t) 262 to a near equivalent physical Position C 264. The Player's objective is to move efficiently along the same path in the physical environment from start to finish as does the Avatar in the virtual environment. However, since the virtual opponent typically moves along random paths and the Player is generally not as mobile as the virtual opponent 254, the player's movement path usually has some position error measured at every sample interval.

e) Once the virtual opponent reaches Position B 260, it immediately changes direction and follows Path3(x,y,z,t) 266 to a virtual Position D 268.

f) The Player perceives and responds to the virtual opponent's new movement path by moving along Path4(x,y,z,t) 270. The Phase Lag Timer is started at the instant the Player's x, y, or z velocity component of movement reaches zero at Position C 264 and his/her movement is directed along the correct Path4(x,y,z,t) 270 to position E 272.

g) When the Player's Position E finally coincides or passes within an acceptable percentage of error measured with respect to the virtual opponent's at Position D 268 the Phase Lag Timer is stopped.

h) The system calculates at each sampling interval the Player's new position velocity, acceleration, and power.

i) The system provides real time numerical and graphical feedback of the calculations of part h and the Phase Lag Time.

3.) First Step Quickness—A third novel measurement is the player's first step quickness. In certain protocols of the present invention, first step quickness is measured as the player attempts to establish or restore a synchronous relationship with the offensive virtual opponent. First step quickness is equally important for creating an asynchronous movement event for an offensive player.

Acceleration is defined as the rate of increase of velocity over time and is a vector quantity. In sports vernacular, an athlete with first step quickness has the ability to accelerate rapidly from rest; an athlete with speed has the ability to reach a high velocity over longer distances. One of the most valued attributes of a successful athlete in most sports is first step quickness.

This novel measurement construct purports that acceleration is a more sensitive measure of "quickness" over short, sport-specific movement distances than is average velocity or speed. This is especially true since a realistic simulation of sports movement challenges, which are highly variable in distance, would not be dependent upon fixed start and end positions. A second reason that the measurement of acceleration over sport-specific distances appears be a more sensitive and reliable measure in that peak accelerations are reached over shorter distances, as little as one or two steps.

First step quickness can be applied to both static and dynamic situations. Static applications include quickness related to base stealing. Truly sports relevant quickness means that the athlete is able to rapidly change his movement pattern and accelerate in a new direction towards his goal. This type of quickness is embodied by Michael Jordan's skill in driving to the basket. After making a series of misleading movement cues, Jordan is able to make a rapid, powerful drive to the basket. The success of this drive lies in his first step quickness. Valid measures of this sports skill must incorporate the detection and quantifying of changes in movement based upon preceding movement. Because the vector distances are so abbreviated and the player is typically already under movement prior to "exploding", acceleration, power and/or peak velocity arc assumed to be the most valid measures of such performance. Measures of speed or velocity over such distances may not be reliable, and at best, are far less sensitive indicators.

Numerous tools are available to measure the athlete's average velocity between to two points, the most commonly employed tool is a stopwatch. By knowing the time required to transit the distance between a fixed start and end position, i.e., a known distance and direction, the athlete's average velocity can be accurately calculated. But just as an automobile's zero to sixty-mph time, a measure of acceleration, is more meaningful to many car aficionados than its top speed, an average velocity measure does not satisfy interest in quantifying the athlete's first step quickness. Any sport valid test of 1st step quickness must replicate the challenges the athlete will actually face in competition.

In situations where the athlete's movement is over short, sport-specific distances that are not fixed start and stop positions, the attempt to compare velocities in various vectors of unequal distance is subject to considerable error. For example, comparison of bilateral vector velocities achieved over different distances will be inherently unreliable in that the athlete, given a greater distance, will achieve higher velocities. And conventional testing means, i.e., without continual tracking of the player, can not determine peak velocities, only average velocities.

Figure 5:
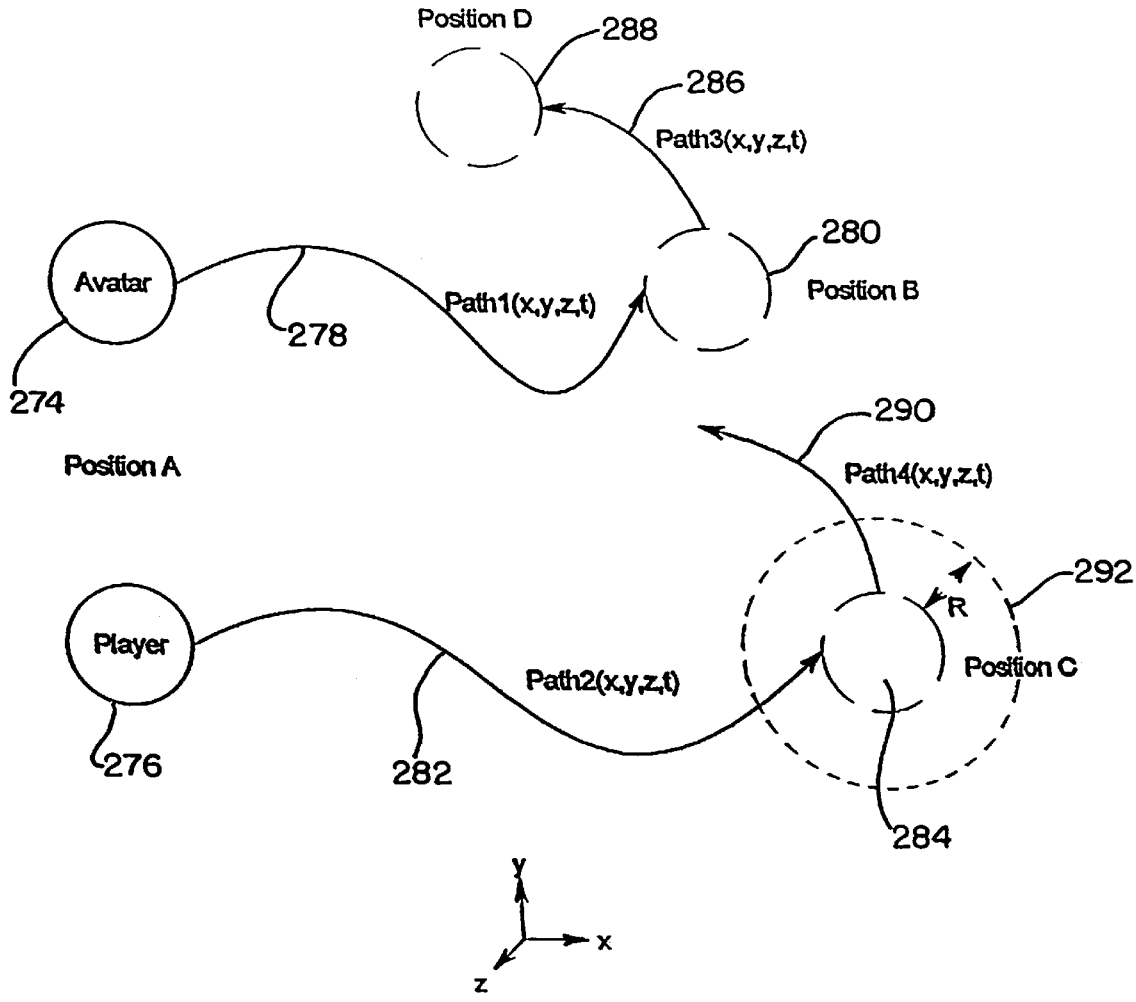
FIG. 5 is a graphical representation of a simulated task that the system executes to determine First Step Quickness.

Only by continuous, high-speed tracking of the athlete's positional changes in three planes of movement can peak velocity, acceleration, and/or power be accurately measured. For accurate assessment of bilateral performance, the measurement of power, proportional to the product of velocity and acceleration, provides a practical means for normalizing performance data to compensate for unequal distances over varying directions since peak accelerations are achieved within a few steps, well within a sport-specific playing area. First step quickness is determined as follows:

Referring to FIG. 5, a) A beacon, a component of the optical tracking system, is worn at the Player's waist.

b) Alt Position A, software scaling parameters make the virtual opponent 224, coordinates in the virtual environment equivalent to the player's 276 coordinates in the physical environment.

c) The system's video displays the virtual opponent's movement along Path1(x,y,z,t) 278 to a virtual Position B 280.

d) In response, the Player moves along Path2(x,y,z,t) 282 to a near equivalent physical Position C 284. The Player's objective is to move efficiently along the same path in the physical environment from start to finish as does the virtual opponent in the virtual environment, however; since the virtual opponent typically moves along random paths and the Player is generally not as mobile as the virtual opponent, the player's movement path usually has some position error measured at every sample interval.

e) Once the virtual opponent reaches Position B 280, it immediately changes direction and follows Path3(x,y,z,t) 286 to a virtual Position D 288.

f) The Player perceives and responds to the virtual opponent's new movement path by moving along Path4(x,y,z,t) 290 with intentions to comply to virtual opponent's new movement path.

g) The system calculates at each sampling interval the Player's new position, velocity, acceleration, and power. Within a volume 292 having radius R, either the measurement of peak acceleration or the measurement of peak power, proportional to the product of peak velocity and acceleration, characterizes First Step Quickness.

h) The system provides real time numerical and graphical feedback of the calculations of part g.

4.) Dynamic Reactive Bounding—A fourth novel measurement is the player's ability to jump or bound in response to cueing that evokes a sport specific response in the player. In certain protocols of the present invention, measured constructs include the player's dynamic reaction time in response to the virtual opponent's jumps as well as the player's actual jump height and/or bound distance and trajectory. Static measures of jumping (maximal vertical jump) have poor correlation to athletic performance. Dynamic measurements made within the present invention's simulation provide sports relevant information by incorporating the variable of time with respect to the jump or bound.

A jump is a vertical elevation of the body's center of gravity; specifically a displacement of the CM (Center of Mass) in the Y plane. A jump involves little, if any, horizontal displacement. In contrast, a bound is an elevation of the body's center of gravity having both horizontal and vertical components. The resulting vector will produce horizontal displacements in some vector direction.

Both the high jump and the long jump represent a bound in the sport of track and field. Satisfactory measures currently exist to accurately characterize an athlete's performance in these track and field events. But in these individual field events, the athlete is not governed by the unpredictable nature of game play.

Many competitive team sports require that the athlete elevate his or her center of gravity (Y plane), whether playing defense or offense, during actual game play. Examples include rebounding in basketball, a diving catch in football, a volleyball spike, etc. Unlike field events, the athlete must time her or his response to external cues or stimuli, and most frequently, during periods of pre-movement. In most game play, the athlete does not know exactly when or where he or she must jump or bound to successfully complete the task at hand.

It is universally recognized that jumping and bounding ability is essential to success in many sports, and that it is also a valid indicator of overall body power. Most sports training programs attempt to quantify jumping skills to both appraise and enhance athletic skills. A number of commercially available devices are capable of measuring an athlete's peak jump height. The distance achieved by a bound can be determined if the start and end points are known. But no device purports to measure or capture the peak height (amplitude) of a bounding exercise performed in sport relevant simulation. The peak amplitude can be a sensitive and valuable measure of bounding performance. As is the case with a football punt, where the height of the ball, i.e., the time in the air, is at least as important as the distance, the height of the bound is often as important as the distance.

The timing of a jump or bound is at as critical to a successful spike in volleyball or rebound in basketball as its height. The jump or bound should be made and measured in response to an unpredictable dynamic cue to accurately simulate competitive play. The required movement vector may be known (volleyball spike) or unknown (soccer goalie, basketball rebound).

Figure 6:
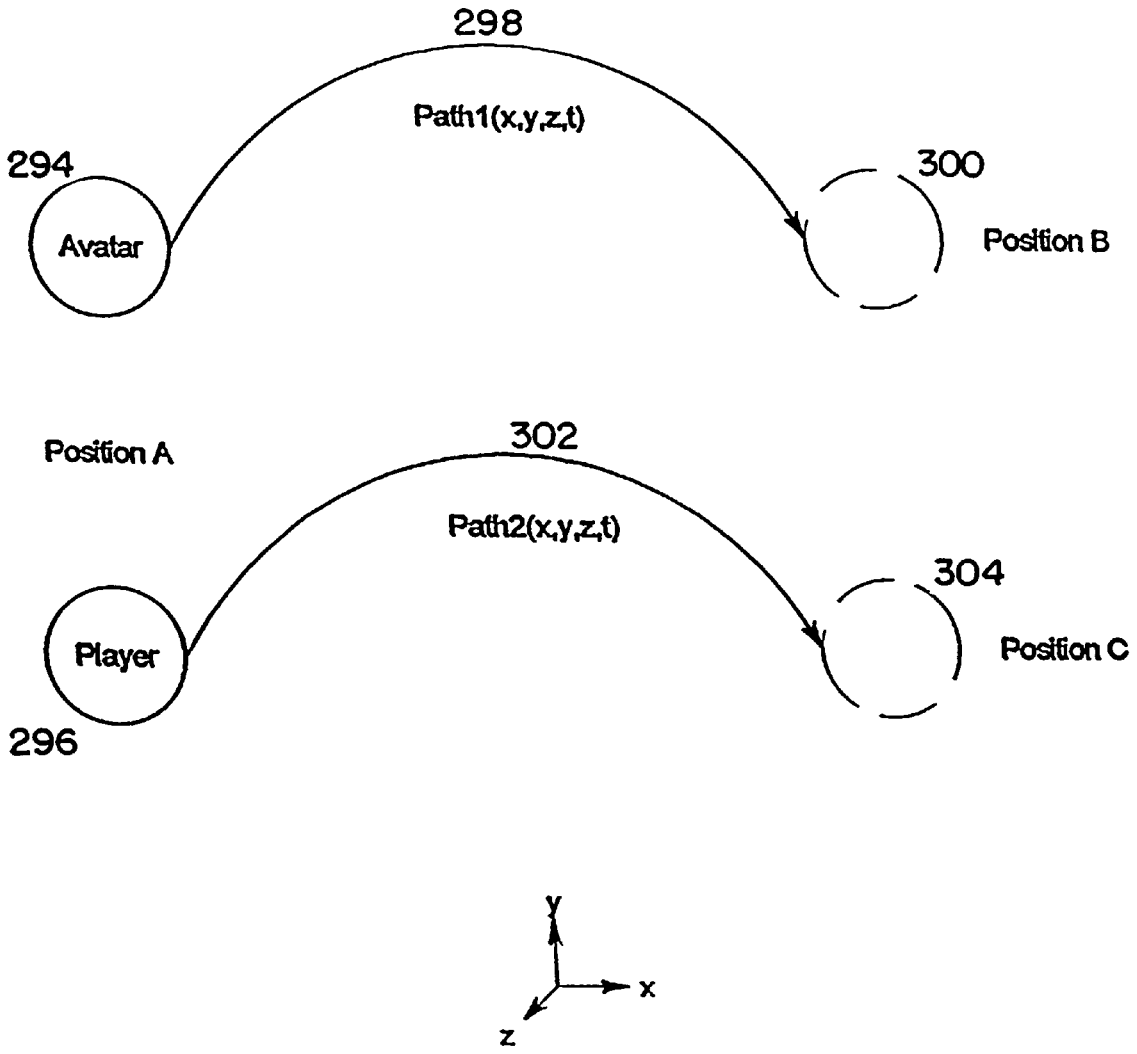
FIG. 6 is a graphical representation of a simulated task that the system executes to determine Dynamic Reactive Bounding.

This novel measurement construct tracks in real time the actual trajectory of a jump or bound performed during simulations of offensive and defensive play. To measure the critical components of a jump or bound requires continuous sampling at high rates to track the athlete's movement for the purpose of detecting the peak amplitude as well as the distance achieved during a jumping or bounding event. Real time measurements of jumping skills include jump height, defined as the absolute vertical displacement of CM during execution of a vertical jump; and for a bound, the peak amplitude, distance and direction. Reactive Bounding is determined as follows:

Referring to FIG. 6, a) A beacon, a component of the optical tracking system, is worn at the Player's waist.

b) At Position A, software scaling parameters make the virtual opponent 294, or virtual opponent's coordinates in the virtual environment equivalent to the player's 296 coordinates in the physical environment.

c) The system's video displays the virtual opponent's movement along Path1(x,y,z,t) 298 to a virtual Position B 300. The virtual opponent's resultant vector path or bound is emphasized to elicit a similar move from the Player 296.

d) In response, the Player 296 moves along Path2(x,y,z,t) 302 to a near equivalent physical Position C 304. The Player's objective is to move efficiently along the same path in the physical environment from start to finish as does the virtual opponent in the virtual environment. However, since the virtual opponent typically moves along random paths and the Player is generally not as mobile as the virtual opponent, the player's movement path usually has some position error measured at every sample interval.

e) The system calculates at each sampling interval the Player's new position, velocity, acceleration, and power. In addition, components of the Player's bounding trajectory, i.e., such as air time, maximum y-displacement, are also calculated.

f) The system provides real time numerical and graphical feedback of the calculations of part e. The Player's bounding trajectory is highlighted and persists until the next bound is initiated.

5.) Dynamic Sports Posture—A fifth novel measurement is the player's Sports Posture during performance of sport specific activities. Coaches, players, and trainers universally acknowledge the criticality of a player's body posture during sports activities. Whether in a defensive or offensive role, the player's body posture during sports specific movement directly impacts sport specific performance. An effective body posture optimizes such performance capabilities as agility, stability and balance, as well as minimizes energy expenditure. An optimum posture during movement enhances control of the body center of gravity during periods of maximal acceleration, deceleration and directional changes. For example, a body posture during movement in which the center of gravity is "too high" may reduce stability as well as dampen explosive movements; conversely, a body posture during movement that is "too low" may reduce mobility. Without means of quantifying the effectiveness of a body posture on performance related parameters, discovering the optimum stance or body posture is a "hit or miss" process without objective, real time feedback.

Optimal posture during movement can be determined by continuous, high speed tracking of the player's CM in relationship to the ground during execution of representative sport-specific activities. For each player, at some vertical (Y plane) CM position, functional performance capabilities will be optimized. To determine that vertical CM position that generates the greatest sport-specific performance for each player requires means for continual tracking of small positional changes in the player's CM at high enough sampling rates to capture relevant CM displacements. It also requires a sports simulation that prompts the player to move as she or he would in actual competition, with abrupt changes of direction and maximal accelerations and decelerations over varying distance and directions.

Figure 7:
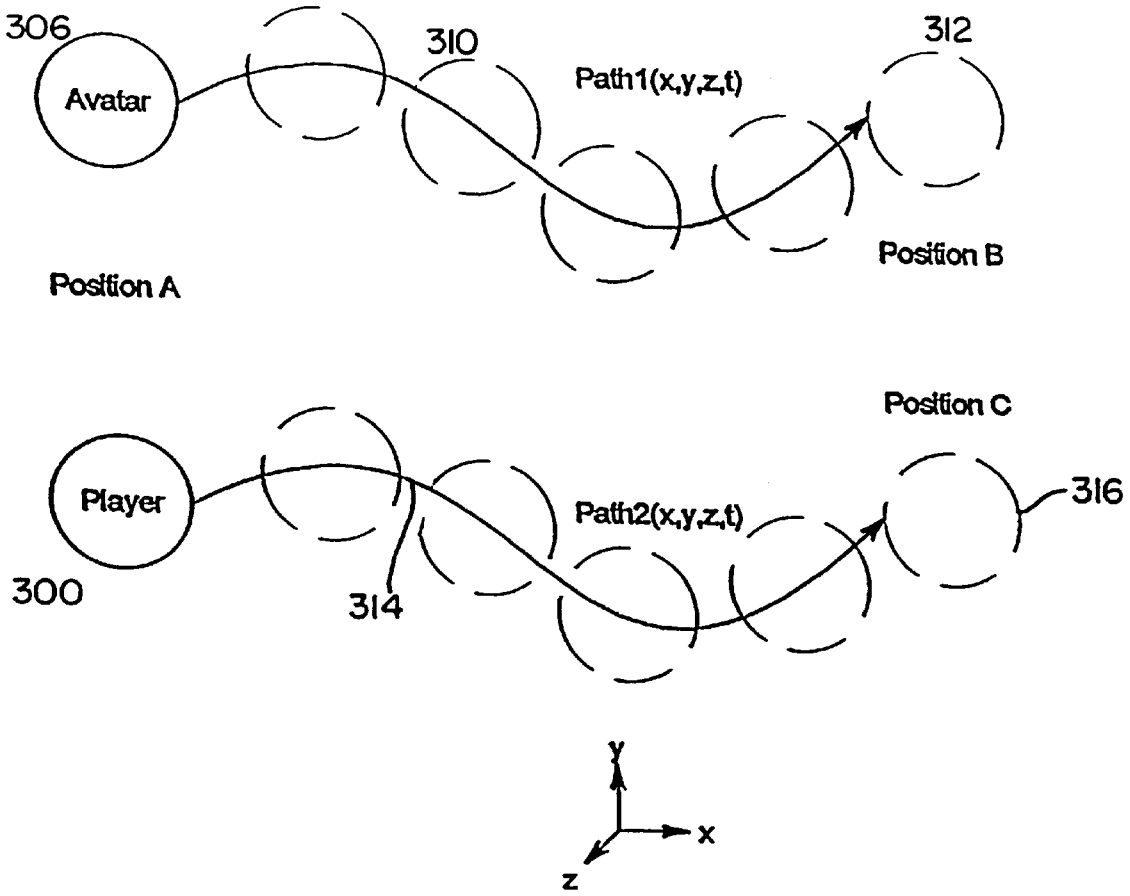
FIG. 7 is a graphical representation of a simulated task that the system executes to determine Dynamic Sports Posture.

Training optimum posture during movement requires that the player strive to maintain their CM within a prescribed range during execution of movements identical to those experienced in actual game play. During such training, the player is provided with immediate, objective feedback based on compliance with the targeted vertical CM. Recommended ranges for each player can be based either on previously established normative data, or could be determined by actual testing to determine that CM position producing the higher performance values. Optimal dynamic posture during sport-specific activities is determined as follows:

Referring to FIG. 7, a) A beacon, a component of the optical tracking system, is worn at the Player's waist.

b) At Position A, software scaling parameters make the virtual opponent 306, coordinates in the virtual environment equivalent to the player's 308 coordinates in the physical environment.

c) The system's video displays the virtual opponent's movement along Path1(x,y,z,t) 310 to a virtual Position B 312.

d) In response, the Player moves along Path2(x,y,z,t) 314 to a near equivalent physical Position C 316. The Player's objective is to move efficiently and in synchronicity to the virtual opponent's movement along the same path in the physical environment from start to finish as does the virtual opponent in the virtual environment. However, since the virtual opponent 306 typically moves along random paths and the Player 308 is generally not as mobile as the virtual opponent, the player's movement path usually has some position error measured at every sample interval.

e) The system calculates at each sampling interval the Player's most efficient dynamic posture defined as the CM elevation that produces the optimal sport specific performance.

f) The system provides real time numerical and graphical feedback of the calculations of part c.

Once the optimal dynamic posture is determine, training optimal dynamic posture is achieved by:

a) A beacon, a component of the optical tracking system, is worn at the Player's waist.

b) The Player 308 assumes the dynamic posture that he/she wishes to train.

c) The system provides varying interactive movement challenges over sport specific distances and directions, including unplanned movements.

d) Y-plane positions, velocity, accelerations and power measurements that are greater or less than or equal to the pre-set threshold or window will generate real-time feedback of such violations for the Player 308.

e) The system provides real-time feedback of compliance with the desired dynamic posture during performance of the protocols.

6.) Functional Cardio-respiratory Status—The sixth novel functional measurement is the player's cardio-respiratory status during the aforementioned sports specific activities. In most sports competitions, there are cycles of high physiologic demand, alternating with periods of lesser demand. Cardiac demand is also impacted upon by situational performance stress and attention demands. Performance of the cardio-respiratory system under sports relevant conditions is important to efficient movement.

Currently, for the purposes of evaluating the athlete's cardio-respiratory fitness for sports competition, stationary exercise bikes, treadmills and climbers are employed for assessing cardiac response to increasing levels of physical stress. Though such exercise devices can provide measures of physical work, they are incapable of replicating the actual stresses and conditions experienced by the competitive athlete in most sports. Accordingly, these tests are severely limited if attempts are made to correlate the resultant measures to actual sport-specific activities. It is well known that heart rate is influenced by variables such as emotional stress and the type of muscular contractions, which can differ radically in various sports activities. For example, heightened emotional stress, and a corresponding increase in cardiac output, is often associated with defensive play as the defensive player is constantly in a "coiled" position anticipating the offensive player's next response.

For the cardiac rehab specialist, coach, or athlete interested in accurate, objective physiological measures of sport-specific cardiovascular fitness, no valid tests have been identified. A valid test would deliver sport-specific exercise challenges to cycle the athlete's heart rate to replicate levels observed in actual competition. The athlete's movement decision-making and execution skills, reaction time, acceleration-deceleration capabilities, agility and other key functional performance variables would be challenged. Cardiac response, expressed as heart rate, would be continuously tracked as would key performance variables. Feedback of heart rate vs. sport-specific performance at each moment in time will be computed and reported.

Functional cardio-respiratory fitness is a novel measurement construct capable of quantifying any net changes in sport-specific performance relative to the function of the cardio-respiratory system. Functional cardio-respiratory status is determined as follows:

a) A beacon, a component of the optical tracking system, is worn at the Player's waist.

b) A wireless heart rate monitor (36A, FIG. 2) is worn by the Player. The monitor communicates in real-time with the system.

c) The system provides sport-specific exercise challenges to cycle the Player's heart rate to replicate levels observed in actual sport competition.

d) The system provides interactive, functional planned and unplanned movement challenges over varying distances and directions.

e) The system provides real-time feedback of compliance with a selected heart-rate zone during performance of defined protocols.

f) The system provides a real-time numerical and graphical summary of the relationship or correlation between heart rate at each sample of time and free-body physical activity.

7.) Dynamic Reactive Cutting—The seventh novel construct is a unique measure of the player's ability to execute an abrupt change in position, i.e., a "cut". Cutting can be a directional change of a few degrees to greater than 90 degrees. Vector changes can entail complete reversals of direction, similar to the abrupt forward and backward movement transitions that may occur in soccer, hockey, basketball, and football. The athlete running at maximum velocity must reduce her or his momentum before attempting an aggressive directional change; this preparatory deceleration often occurs over several gait cycles. Once the directional change is accomplished, the athlete will maximally accelerate along his or her new vector direction.

Accurate measurement of cutting requires:

continuous tracking of position changes in three planes of movement;

ascertaining the angle scribed by the cutting action;

measuring both the deceleration during braking prior to direction change; and the acceleration af ter completing the directional change.

For valid testing, the cues (stimuli) prompting the cutting action must be unpredictable and interactive so that the cut can not be pre-planned by the athlete, except under specific training conditions, i.e. practicing pass routes in football. It must be sport-specific, replicating the types of stimuli the athlete will actually experience in competition. The validity of agility tests employing ground positioned cones and a stopwatch, absent sport-relevant cueing, is suspect. With knowledge of acceleration and the player's bodyweight, the power produced by the player during directional changes can also be quantified.

Vector Changes and Reactive Cutting are determined as follows:

Referring to FIG. 8, a) A beacon, a component of the optical tracking system, is worn at the Player's waist.

b) At Position A, software scaling parameters make the virtual opponent 318, or virtual opponent's coordinates in virtual environment equivalent to the player's 320 coordinates in the physical environment.

c) The system's video displays the virtual opponent's movement along Path1(x,y,z,t) 322 to a virtual Position B 324.

d) In response, the Player 320 moves along Path2(x,y,z,t) 326 to a near equivalent physical Position C 328. The Player's objective is to move efficiently along the same path in the physical environment from start to finish as does the virtual opponent 318 in the virtual environment. However, since the virtual opponent typically moves along random paths and the Player is generally not as mobile as the virtual opponent, the player's movement path usually has some position error measured at every sample interval.

e) Once the virtual opponent 310 reaches Position B 324, it immediately changes direction and follows Path3(x, y,z,t) 330 to a virtual Position D 332.

f) The Player perceives and responds to the virtual opponent's new movement path by moving along Path4(x, y,z,t) 334 to physical Position E 336.

g) Once the virtual opponent 318 reaches virtual Position D 332, it immediately changes direction and follows Path5(x,y,z,t) 338 to virtual Position F 340.

h) The Player perceives and responds to the virtual opponent's new movement path by moving along Path6(x,y,z,t) 342 to physical Position G 344.

i) Subsequent virtual opponent 318 movement segments are generated until sufficient repetition equivalency is established for all vector movement categories represented during the performance of sport-specific protocols, including unplanned movements over various distances and direction.

j) The system calculates at each sampling interval the Player's new position and/or velocity and/or acceleration and/or power and dynamic reactive cutting.

k) The system provides real time numerical and graphical feedback of the calculations of part j.

It should be noted that these motor-related components of sports performance and fitness are equally important to safety, success and/or productivity in demanding work environments, leisure sports, and many activities of daily living. The Surgeon General's Report on Physical Activity and Health defined Physical Fitness as "an ability to carry out daily tasks with vigor and alertness, without undue fatigue, and with ample energy to enjoy leisure-time pursuits and to meet unforeseen emergencies." The Report further defined Physical Fitness by Performance and Health related attributes.

The performance-related components are often characterized as either the sport-specific, functional, skill or motor-related components of physical fitness. These performance-related components are obviously essential for safety and success in both competitive athletics and vigorous leisure sports activities. It should be equally obvious that they are also essential for safety and productive efficiency in demanding physical work activities and unavoidably hazardous work environments such as police, fire and military—as well as for maintaining independence for an aging population through enhanced mobility and movement skills.

We claim:

1. A system for assessing a user's movement capabilities in a defensive role to maintain a synchronous relationship with a virtual opponent comprising:

means for measuring in real time said user's position changes as said user responds to said virtual opponent;

means for measuring deviations of said user from said synchronous relationship;

means for providing indices of said user's ability to minimize said deviations from said synchronous relationship; and means for providing indices of said measured deviations from said synchronous relationship.

2. A system for assessing the movement capabilities of a user in an offensive role to create an asynchronous relationship comprising:

means for measuring in real time said user's position changes;

means for providing a virtual opponent for said user to evade; and means for providing indices of said user's ability to maximize deviations between said user and said virtual opponent during a time interval.

3. A system for assessing the movement capabilities of a user in an offensive role comprising:

means for measuring in real time said user's position changes;

means for prompting said user to undertake sport specific movement;

cueing means for prompting a change in said user's sport specific movement;

and means for providing indices of said user's change of sport specific movement.

* * * * *